United States Patent [19]

Kirkpatrick et al.

[11] 4,314,501

[45] Feb. 9, 1982

[54] HIGH RATE OF FIRE REVOLVING BATTERY GUN

[75] Inventors: Robert G. Kirkpatrick, Shelburne; Ronald R. Snyder, Georgia, both of Vt.

[73] Assignee: General Electric Company, Burlington, Vt.

[21] Appl. No.: 120,442

[22] Filed: Feb. 11, 1980

[51] Int. Cl.[3] ..... F41D 7/02

[52] U.S. Cl. ..... 89/12

[58] Field of Search ..... 89/12, 13 R, 13 A, 126

[56] References Cited

U.S. PATENT DOCUMENTS

| | | | |
|---|---|---|---|
| 125,563 | 4/1872 | Gotling | 89/12 |
| 2,849,921 | 9/1958 | Otto | 89/126 X |
| 2,872,847 | 2/1959 | Otto | 89/12 |
| 3,611,871 | 10/1971 | Kirkpatrick et al. | 89/12 X |
| 3,766,821 | 10/1973 | Cozzy et al. | 89/12 |
| 3,897,714 | 8/1975 | Perrin et al. | 89/12 |
| 4,015,508 | 4/1977 | Blodgett et al. | 89/12 |
| 4,114,510 | 9/1978 | Prince et al. | 89/12 |

OTHER PUBLICATIONS 20 mm. Weapons Applications Data, MPB-438 (General Electric) FIG. 4, M61A1 Gun.

*Primary Examiner*—David H. Brown

*Attorney, Agent, or Firm*—Bailin L. Kuch

[57] ABSTRACT

A feature of this invention is the provision of a Gatling type gun whose gun barrels are arranged in a truncated cone and whose gun bolts are coaxial with their respective gun barrels.

5 Claims, 3 Drawing Figures

HIGH RATE OF FIRE REVOLVING BATTERY GUN

BACKGROUND OF THE INVENTION

1. Field of the Invention

This invention relates to Gatling type guns, and more particularly to the angles of the longitudinal axes of the gun barrel and the gun bolt with the longitudinal axis of the rotor.

2. Prior Art

The classic gun as shown by R. J. Gatling in U.S. Pat. No. 125,563, issued Apr. 9, 1872 apparently had all of its gun barrels and their respective gun bolts on longitudinal axes which were parallel to the longitudinal axis of the rotor, i.e., the axes formed a cylinder. H. McC. Otto in U.S. Pat. No. 2,872,847, issued Feb. 10, 1959, proposed to skew the cylinder of gun barrels to provide upon firing a force component in the direction of rotation, so as to reduce the external power required to drive the gun. In the M61A1 Vulcan gun the gun barrels are arranged in a truncated cone, with each gun barrel on a longitudinal axis which is at 0°45′ to the longitudinal axis of the rotor. In the GAU-8/A gun a smaller angle was used. Perrin et al in U.S. Pat. No. 3,897,714 issued Aug. 5, 1975 teaches deflecting the muzzle end of the gun barrels towards or away from the longitudinal axis of the rotor. Similar deflections are shown by R. F. Prince et al in U.S. Pat. No. 4,114,510 issued Sept. 19, 1978 and by F. M. Blodgett Jr. et al in U.S. Pat. No. 4,015,508 issued Apr. 5, 1977.

However, in all of these guns, the gun bolts have a longitudinal axis, and reciprocate along paths, which are parallel to the longitudinal axis of the rotor. The lack of coaxialism of the gun barrel and its respective gun bolt provides several disadvantages: A vertical load vector is imparted to the gun bolt on firing. The projectile of the round of ammunition may strike the top of the chamber of the gun barrel during the ramming stroke. In the larger calibers the face of the gun bolt should be machined at an angle other than 90° to the longitudinal axis of the gun bolt.

SUMMARY OF THE INVENTION

It is an object of this invention to provide a Gatling type gun where gun barrels are arranged in a truncated cone which avoids generating a vertical load vector in its gun bolts, which eliminates the possibility of a round striking a chamber during ramming, and whose gun bolts are relatively easier to machine.

A feature of this invention is the provision of a Gatling type gun whose gun barrels are arranged in a truncated cone and whose gun bolts are coaxial with their respective gun barrels.

BRIEF DESCRIPTION OF THE DRAWING

These and other objects, features and advantages of this invention will be apparent from the following specification thereof taken in conjunction with the accompanying drawing in which.

THE PREFERRED EMBODIMENT

Figure 1:
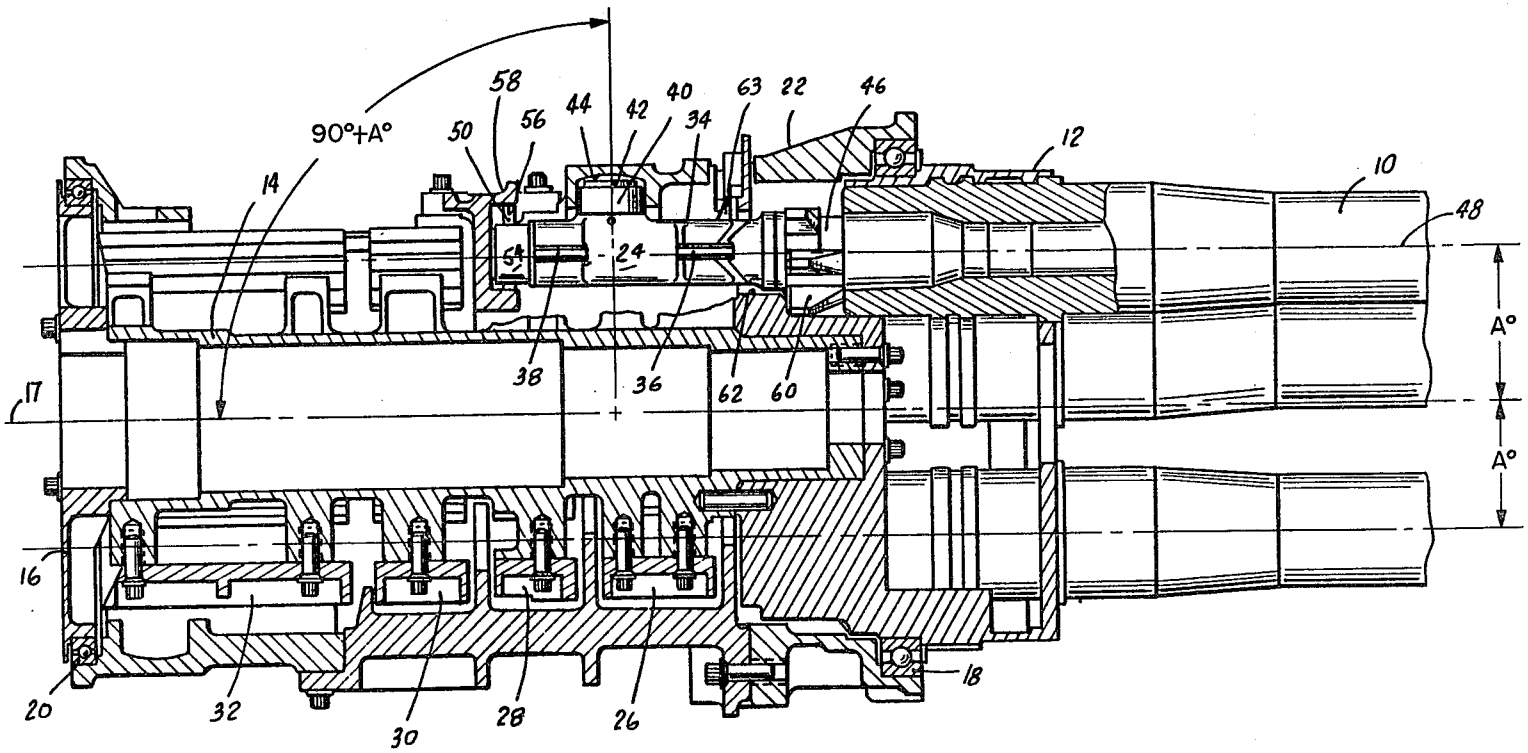
FIG. 1 is a longitudinal view of a Gatling type gun embodying this invention.

The Gatling type gun shown in FIG. 1 is of the type shown in Ser. No. 118,028, filed Feb. 4, 1980 by R. G. Kirkpatrick. The gun includes a plurality, e.g., five, of gun barrels 10, fixed to a forward rotor 12, which is fixed to an aft rotor 14, which is fixed to an aft cover 16, and are all journaled for rotation about a longitudinal axis 17 by a forward bearing 18 and an aft bearing 20, in a stationary three-part housing 22. A plurality, e.g., five, of sets of tracks are bolted to the rotor, to receive between adjacent sets a like plurality of gun bolts 24. Each set includes tracks 26, 28, 30 and 32. Each gun bolt assembly 24 includes a bolt carriage or body 34 having slides 36, 38 which engage the tracks of the rotor. A gun bolt roller or cam follower 40 is journaled to a headed pin 42 which is fixed on a radial axis to the bolt body 34. This roller 40 rides in the main cam track 44 formed in the housing 22. As the rotor assembly 12, 14 rotates with its gun bolts 24, the main cam track 44 reciprocates the gun bolts to and between their forward and aft dwells. A breech bolt or bolt head 46 is journaled in the bolt body 34 for limited oscillation about its longitudinal axis 48. A linear rotary motion roller 50 is journaled on a headed pin which is fixed to a cam follower 54 on an axis which is parallel to and spaced from the longitudinal axis of the bolt head. The cam follower is fixed to and coaxial with the bolt head. During front dwell of the gun bolt the roller 50 engages a cam track 56 formed in a locking cam 58 which is fixed to the gun housing 22. As the rotor assembly rotates, the cam track 56 oscillates the bolt head 46 about its longitudinal axis 48 from unlock to lock to unlock, whereby the locking lugs 60 on the bolt head engage and disengage with the locking lugs 62 formed in the forward rotor 12 adjacent the aft ends of the gun barrels 10.

The gun barrels form a truncated cone with the longitudinal axis of each gun barrel 10 forming an included angle with the longitudinal axis of the gun, i.e., the rotor 12, of A, here shown as 0.5°. Each of the gun bolt assemblies 24 has a longitudinal axis which is coaxial with its respective gun barrel, and this is accomplished by having each set of tracks 26, 28, 30 and 32 providing a path for its respective gun bolt which is coaxial with its respective gun barrel. The generating axis of the main cam track 44 is set at an included angle of 90° +A, here shown as 90.5° with the gun axis so as to provide side walls on the cam track which are parallel to the peripheral wall of the bolt cam follower 40.

Figure 3:
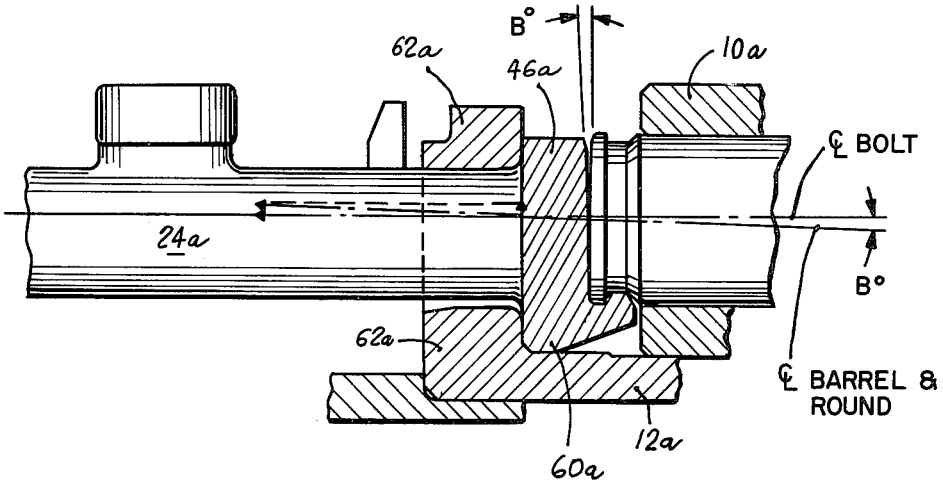
FIG. 3 PRIOR ART
FIG. 3 is a showing similar to FIG. 2 of the prior art.

As shown in FIG. 3, the recent prior art Gatling type guns had their gun barrels forming a truncated cone with the longitudinal axis of each gun barrel 10*a* forming an included angle with the longitudinal axis of the gun of B. The gun bolt assemblies 24 ran on tracks which provided pathways which were parallel to the longitudinal axis of the gun, resulting in an included angle between the gun bolt assembly axis and the respective gun barrel axis of B. If the face of the gun bolt head was perpendicular to the longitudinal axis of the gun bolt, then as the round was inserted into the chamber it was misaligned with the longitudinal axis of the chamber by angle B, and when locked in the chamber its case base was spaced from the bolt face by a wedge of angle B. Alternatively, if the face of the gun bolt head was formed at 90° +B to the longitudinal axis of the gun bolt with the lock orientation of the bolt head as a reference, the wedge shaped space is avoided, but some misalignment on insertion, when the bolt head is in its unlock angular orientation, remains. In either case, the force generated by the firing of the round of ammunition is reacted back into the gun bolt head 46*a* at an angle B to the longitudinal axis of the bolt assembly. The force is resolved into a large component along the bolt axis and a small, but significant component perpendicular to the bolt axis, taken long the interface of the bolt and rotor locking lugs. This force tends to centrifugally disassemble the gun, and to provide a vertical force on the gun mount.

Figure 2:
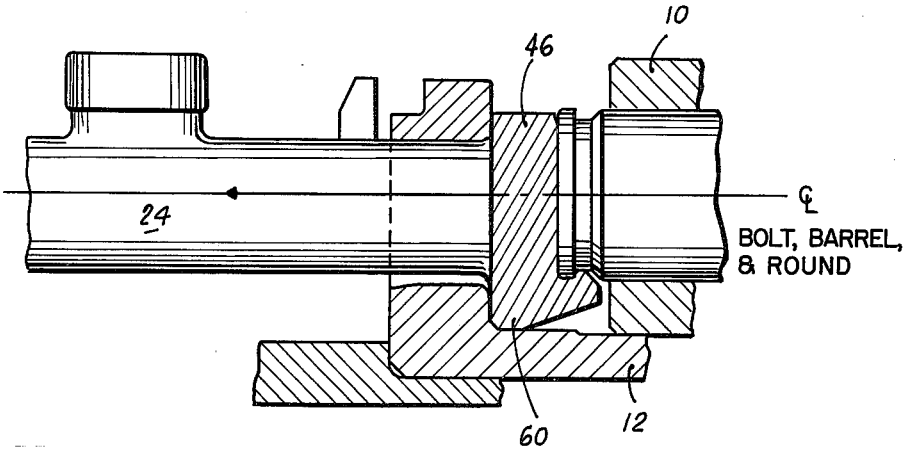
FIG. 2 is a detail of the gun of FIG. 1 showing the gun barrel gun bolt system of this invention.

As shown in FIG. 2, making the bolt assembly and respective gun barrel axes coaxial, avoids all of the above described disadvantages.

What is claimed is:

1. A Gatling type gun including:

a housing;

a rotor journaled in said housing for rotation about a longitudinal axis;

said rotor including:

a plurality of gun barrels, each having a respective longitudinal axis, disposed in an annular row, each of said gun barrels fixed to said rotor with its respective longitudinal axis at an included angle A to said longitudinal axis of said rotor, said included angle A being neither 0° nor 180°, and a like plurality of gun bolt assemblies, each having a respective longitudinal axis, disposed in an annular row, each of said gun bolt assemblies mounted to said rotor with its respective longitudinal axis coaxial with the respective longitudinal axis of a respective gun barrel.

2. A Gatling type gun according to claim 1 wherein:

said rotor has a like plurality of sets of track means with each gun bolt assembly being journaled for reciprocation upon a respective set of track means, each of said set of track means providing a pathway for the respective bolt assembly which is coaxial with the respective gun barrel.

3. A Gatling type gun according to claim 1 wherein:

each of said gun bolt assemblies includes a cam follower roller journaled for rotation about an axis which is perpendicular to said longitudinal axis of said bolt assembly, and said housing includes a main cam track for receiving said roller whose side walls are parallel to said axis of rotation of said roller.

4. A Gatling type gun according to claim 3 wherein:

said respective axis of rotation of each respective cam follower roller is at an included angle B to said longitudinal axis of said rotor, said included angle B being equal to 90° plus said included angle A.

5. A Gatling type gun according to claim 4 wherein:

each of said cam follower rollers has a respective cylindrical external surface which engages said side walls of said main cam track.

* * * * *